US009310060B2

(12) United States Patent
Stolte et al.

(10) Patent No.: US 9,310,060 B2
(45) Date of Patent: Apr. 12, 2016

(54) LUMINAIRE WITH SENSING AND COMMUNICATION CAPABILITIES

(71) Applicant: KENALL MANUFACTURING COMPANY, Gurnee, IL (US)

(72) Inventors: Brandon Stolte, Lindenhurst, IL (US); Brad Wilson, Twin Lakes, WI (US)

(73) Assignee: KENALL MANUFACTURING COMPANY, Kenosha, WI (US)

( * ) Notice: Subject to any disclaimer, the term of this patent is extended or adjusted under 35 U.S.C. 154(b) by 90 days.

(21) Appl. No.: 14/458,868

(22) Filed: Aug. 13, 2014

(65) Prior Publication Data

US 2016/0047537 A1 Feb. 18, 2016

(51) Int. Cl.

| | |
|---|---|
| ***F21V 3/00*** | (2015.01) |
| ***F21V 5/00*** | (2015.01) |
| ***F21V 23/04*** | (2006.01) |
| ***F21V 5/04*** | (2006.01) |
| ***F21V 23/00*** | (2015.01) |

(52) U.S. Cl.

CPC ..... *F21V 23/0435* (2013.01); *F21V 5/04* (2013.01); *F21V 23/009* (2013.01); *F21V 23/0471* (2013.01)

(58) Field of Classification Search

CPC ..... F21V 3/00; F21V 5/04; F21V 13/04; F21V 23/003; F21V 23/009; F21V 23/0442; F21V 23/0464; F21V 23/0471

USPC ..... 362/249.02, 276, 311.02, 311.14, 335, 362/363, 802

See application file for complete search history.

(56) References Cited

U.S. PATENT DOCUMENTS

2012/0176792 A1 7/2012 Stolte et al.

OTHER PUBLICATIONS

TekDek™ Advanced Lighting for Parking Garages Brochure, Kenall, 36 Pages.

*Primary Examiner* — Jason Moon Han

(74) *Attorney, Agent, or Firm* — Marshall, Gerstein & Borun LLP

(57) ABSTRACT

A luminaire with various sensing and communication capabilities is provided. According to one aspect, the luminaire can include a housing, a light source disposed in the housing, a support element coupled to and extending downward from the housing, one or more communication modules disposed within the support element, and a motion sensor coupled to the support element. The one or more communication modules facilitate communication with a local controller disposed in the luminaire, a control system, and/or other luminaires. The motion sensor is configured to detect motion within a pre-determined range of the luminaire. The light source is configured to emit light responsive to the motion sensor detecting motion within the pre-determined range.

27 Claims, 6 Drawing Sheets

LUMINAIRE WITH SENSING AND COMMUNICATION CAPABILITIES

FIELD

The present disclosure generally relates to luminaires and, more particularly, to a luminaire having various sensing and communication capabilities.

BACKGROUND

Many commercial buildings, parking structures, transportation areas or structures (e.g., tunnels), and the like are equipped with lighting systems that typically include several luminaires or light fixtures configured to illuminate certain areas. Some such systems are equipped to energize upon detecting the presence of pedestrians or vehicles within a certain zone in order to improve energy efficiency and/or light pollution. Some such systems also are equipped with wired/wireless communications to facilitate communication with a control server, for example, or even other luminaires.

SUMMARY

One aspect of the present disclosure provides a luminaire that includes a housing, light source, lens, and one or more communication modules. The light source is disposed in the housing. The lens is coupled to the housing and covers the light source. The communication modules are disposed within a support element coupled to the housing and disposed along a center axis of the luminaire extending upward from an apex of the lens.

Another aspect of the present disclosure provides a luminaire that includes a housing, light source, support element, lens, one or more communication modules, and motion sensor. The light source is disposed in the housing. The support element is coupled to and extends downward from the housing. The lens is coupled to the housing and covers the light source and the support element. The communication modules are disposed within the support element. The motion sensor is coupled to the support element and is configured to detect motion within a pre-determined range of the luminaire. The light source is configured to emit light responsive to the motion sensor detecting motion within the pre-determined range.

Another aspect of the present disclosure provides a luminaire that includes a housing, light source, lens, and motion sensor. The light source is disposed in the housing. The lens is coupled to the housing and covers the light source. The motion sensor is disposed adjacent the lens and is configured to detect motion within a pre-determined distance from the luminaire. The light source is configured to emit light responsive to the motion sensor detecting motion within the pre-determined distance.

BRIEF DESCRIPTION OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed embodiments, and explain various principles and advantages of those embodiments.

DETAILED DESCRIPTION

Figure 1:
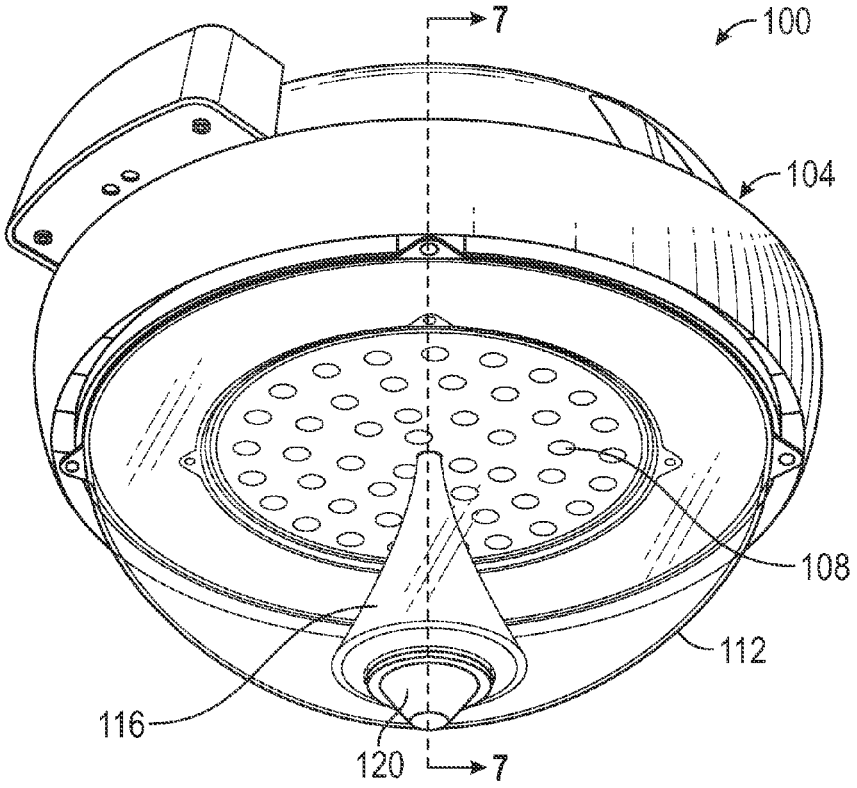
FIG. 1 is a bottom perspective view of a luminaire constructed in accordance with the teachings of the present disclosure.
Figure 2:
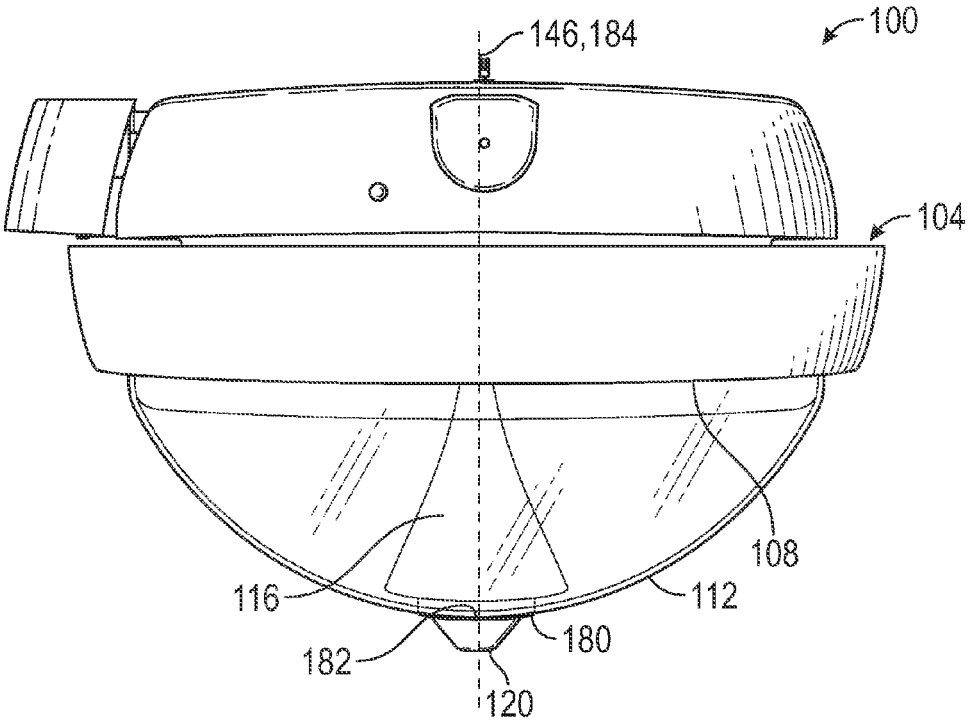
FIG. 2 is a front view of the luminaire shown in FIG. 1.
Figure 3:
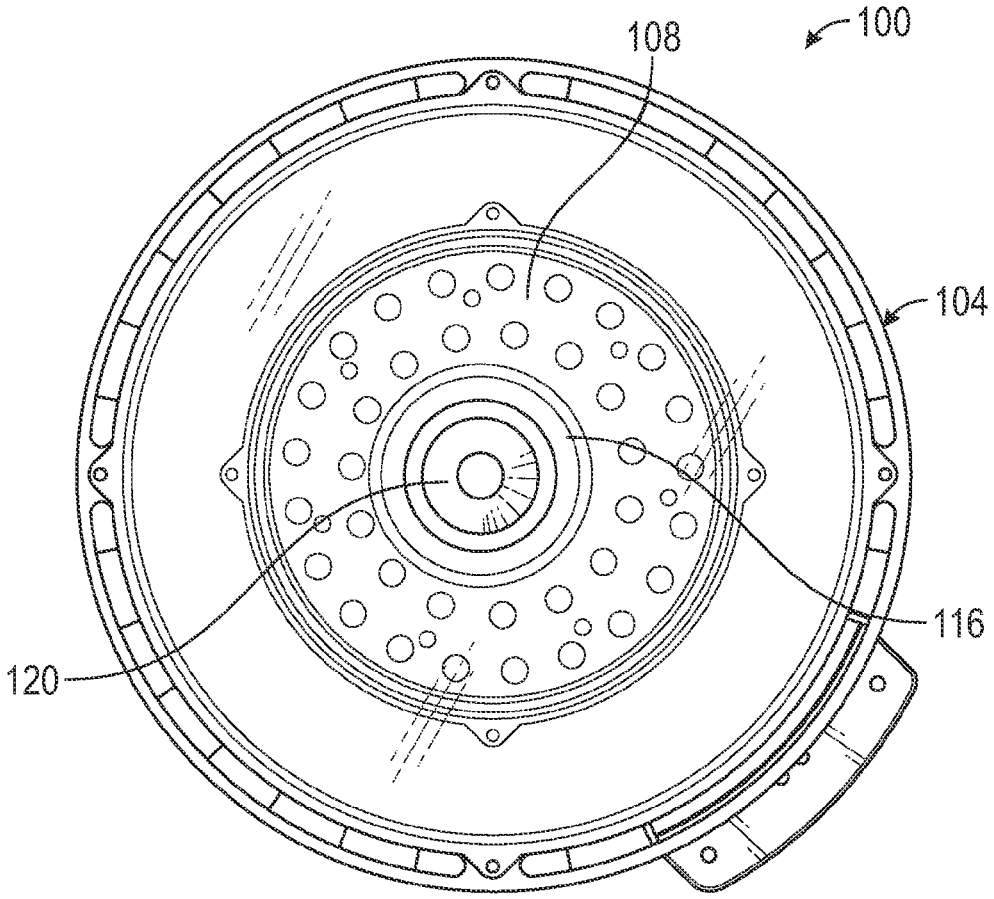
FIG. 3 is a bottom view of the luminaire shown in FIG. 1.

FIGS. 1-3 illustrate one example of a luminaire or lighting fixture 100 constructed in accordance with the present disclosure. The luminaire 100 is generally suitable for either outdoor use or indoor use. The luminaire 100 can, for example, be used in a parking garage, commercial building, roadway, tunnel, residential home or building, or other structure or environment.

Though not explicitly illustrated herein, the luminaire 100 can be associated with a lighting system or a portion thereof, such as, for example, a lighting system included or employed in a parking garage (or a floor or section of the parking garage), commercial building (or a portion thereof), roadway, tunnel, or other structure (or a portion thereof), residential home or building, or other indoor or outdoor space or environment. In some versions, the lighting system can include a plurality of luminaires 100. In one version, the lighting system can include a plurality of uniformly constructed luminaires 100. In another version, the lighting system can include a plurality of luminaires 100 of different types, sizes, and/or shapes. The plurality of luminaires 100 can be connected to one another via a wired or wireless connection (e.g., such as to form a mesh network).

It will be appreciated that such a lighting system can be interfaced with a control system (e.g., the SmartSense control system designed by Kenall Manufacturing Co.) configured to intelligently control the components of the lighting system. In such a situation, the luminaires 100 of the lighting system may be communicatively connected to and, once commissioned, controlled by a central controller or similar device or component of the control system. As such, the luminaires 100 may transmit data, such as operating status, driver status, hardware information, occupancy data, daylight levels, temperature, power consumption, to the central controller (or similar device) and may receive, from the central controller (or similar device), operational instructions (e.g., turn on, turn off, dim, etc.) and/or other data (e.g., operational data from other luminaires 100).

As shown in FIGS. 1-3, the luminaire 100 includes a housing 104, a light source 108 coupled to (e.g., installed or mounted within) the housing 104, a lens 112 coupled to the housing 104 and covering or enclosing the light source 108, an electronics control assembly 116 coupled to and extending downward from the housing 104, and a motion sensor 120 coupled to the electronics control assembly 116. So constructed, the motion sensor 120 is optimally positioned to detect motion within a pre-determined range of or distance from (e.g., 50 feet) the luminaire 100. When the motion sensor 120 detects motion within this pre-determined range, the light source 108 can emit light onto or into an area adjacent or surrounding the luminaire 100. Moreover, when the luminaire 100 is interfaced with a control system as discussed above, and the motion sensor 120 detects motion, this information can be transmitted to the control system (e.g., the central controller or similar device). The control system can control other luminaires 100 and/or other lighting system components based on this information. For example, the control system can turn on, off, or dim a luminaire 100 when motion is detected via the motion sensor 120 of an adjacent luminaire 100. Alternatively or additionally, this information can be transmitted to other luminaires 100 associated with the lighting system.

Figure 4:
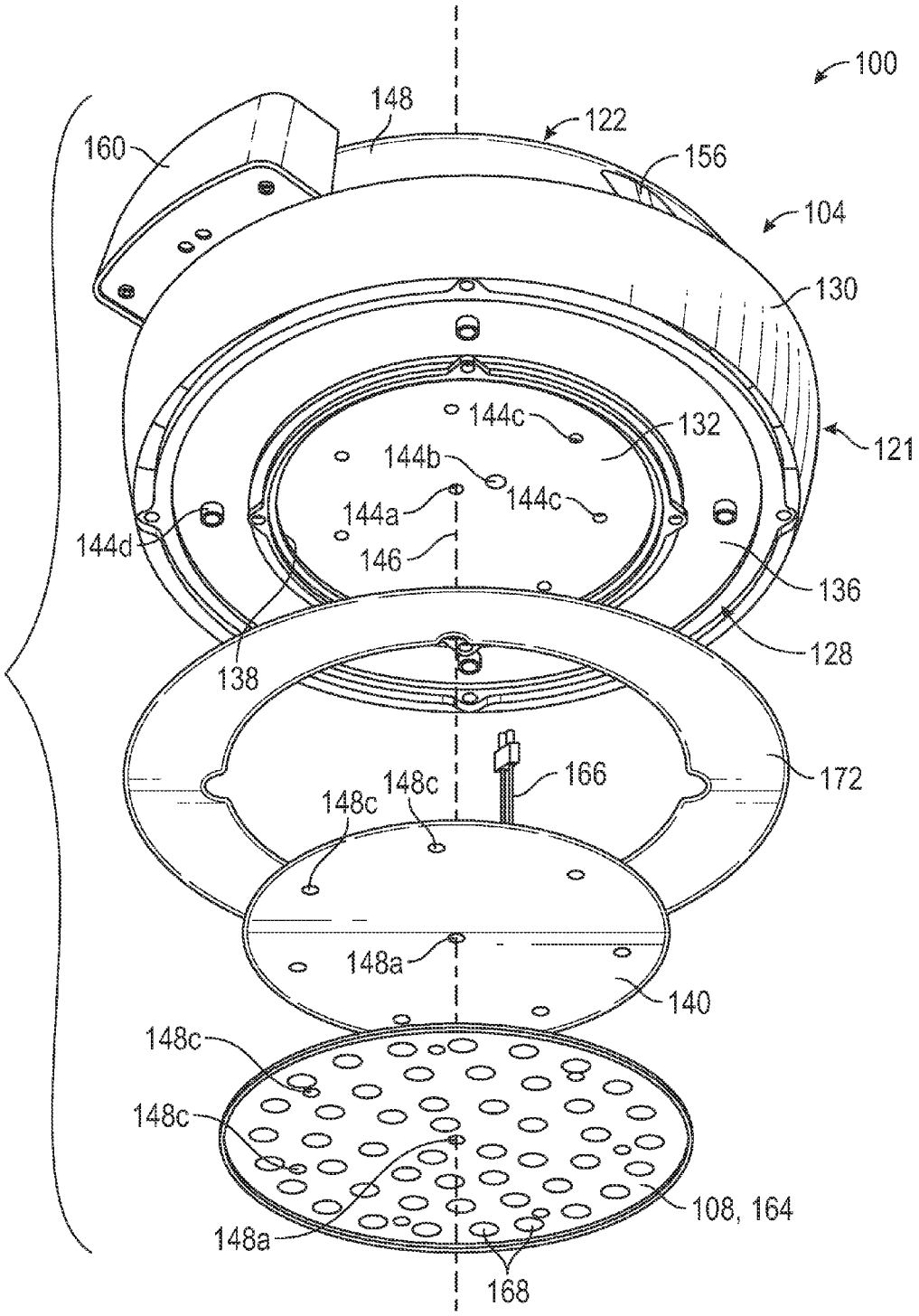
FIG. 4 is a bottom perspective, partially exploded view of the luminaire shown in FIG. 1, with several components of the luminaire removed for clarity.

Turning now to FIG. 4, which depicts a partially exploded view of the luminaire 100 with the lens 112, the electronics control assembly 116, and the sensor 120 removed for clarity, the housing 104 has a domed-shape and is made of or manufactured from die cast aluminum for maximum strength or durability. As shown in FIG. 4, the housing 104 generally includes a cylindrical body 121 and a mounting base 122 coupled to the housing body 121. The body 121 is defined by a top side (not shown), a bottom side 128, and a circumferential wall 130 extending therebetween. As illustrated, the bottom side 128 includes an interior, circular mounting surface 132 and a perimeter mounting surface 136 surrounding or circumscribing the interior mounting surface 132. The interior mounting surface 132 is slightly recessed relative to the perimeter mounting surface 136, thereby forming a cavity 138 for receiving a circular printed circuit board 140 and the light source 108, as will be described in greater detail below. The bottom side 128 also includes a plurality of apertures, particularly an aperture 144A formed in the interior mounting surface 132 along a central longitudinal axis 146 of the housing 104, an aperture 144B formed in the interior mounting surface 132 and offset from the central axis 146, a plurality of apertures 144C formed in the interior mounting surface 132 and circumferentially spaced around the aperture 144A, and a plurality of apertures 144D formed in the perimeter mounting surface 136 and circumferentially spaced apart from one another. The printed circuit board 140 and the light source 108 each include a plurality of apertures as well, including an aperture 148A that is identical in size and position to the aperture 144A and a plurality of apertures 148C identical in size and position to the apertures 144C.

As shown in FIG. 4, the mounting base 122 has a top side 148, a bottom side (not shown), a circumferential wall 156 extending therebetween, and a slightly curved but substantially rectangular housing 160 coupled to and projecting outward from the wall 156. It will be understood that the top side 148 can include a mounting structure (e.g., a bracket, a mounting plate) suitable for mounting or securing the mounting base 122, and, thus the luminaire 100, to a wall, ceiling, or other surface. The bottom side of the mounting base 122 can be coupled to the top side of the body 121 in any known manner.

With continued reference to FIG. 4, the printed circuit board 140, wiring 166 for the circuit board 140, and the light source 108, which in the depicted version is a circular light-emitting diode (LED) board 164 with forty-eight (48) LEDs 168, can be disposed in the cavity 138. The wiring 166 can be inserted into the aperture 144B and passed through and out of the housing 104 for connection to electrical wiring (not shown) to facilitate lighting from the luminaire 100. The printed circuit board 140 and the LED board 164 can be secured in the cavity 138 using a plurality of fasteners (not shown) disposed through the plurality of apertures 148A, 148C and in the plurality of apertures 144A, 144C, with the printed circuit board 140 in direct contact with the interior mounting surface 132 and the LED board 164 in direct contact with the printed circuit board 140. As also illustrated in FIG. 4, a circular reflector 172 can be mounted to the perimeter mounting surface 136 and secured there using a plurality of fasteners (not shown) disposed in the plurality of apertures 144D. So disposed, the reflector 172 surrounds or circumscribes the light source 108. As is known in the art, the reflector 172 is configured to reflect wayward light emitted from the light source 108, thereby causing the light to exit the luminaire 100 in a more focused manner.

Although not depicted herein, it will be understood that one or more drivers (e.g., LED drivers), a heat sink, one or more boards (e.g., a user interface board), wiring, various control components (e.g., a local controller), one or more communication modules (e.g., one or more antennae, one or more receivers, one or more transmitters), and/or other electrical components can be arranged or disposed within the housing body 121 or the mounting base 122 of the housing 104. For example, control components, such as a local controller communicatively connected to the central controller for the control system, can be arranged or disposed within the housing 160 of the mounting base 122.

In other versions, the housing 104 can be constructed differently. Specifically, the housing 104 can have a different size, shape, and/or be made of one or more materials other than or in addition to die cast aluminum (e.g., stainless steel). For example, the housing 104 can have a rectangular, square, triangular, irregular, or other suitable shape. More specifically, the body 121 and/or the mounting base 122 can vary in shape, size, and/or construction. In one version, the mounting base 122 may not include the housing 160, with the result that the housing 104 may not include control components or the control components may be disposed elsewhere.

In other versions, the printed circuit board 140 and the LED board 164 can vary in shape, size, and/or be arranged differently relative to one another and/or to the housing 104. While the printed circuit board 140 and the LED board 164 are each circular in shape, the printed circuit board 140 and/or the LED board 164 can instead have a rectangular, square, triangular, irregular, or other suitable shape. The printed circuit board 140 and the LED board 164 can be coupled to the housing 104 in a different manner than the apertures and fasteners described above (e.g., using adhesive, using some other mechanical connection). In other versions, the LED board 164 can include greater or fewer LEDs disposed thereon and/or the LEDs can be arranged in a different manner. For example, the LED board 164 can include six (6) LEDs, twenty-four (24) LEDs, seventy-two (72) LEDs, or some other number of LEDs. Other types of lighting for the luminaire 100 are also envisioned, with the light source 108 taking the form of one or more fluorescent, incandescent, plasma, or other lights.

With reference back to FIGS. 1-3, the lens 112 will now be described in greater detail. The lens 112 in this version is generally translucent and has a substantially hemi-spherical shape. The lens 112 can be made of or from a textured acrylic, textured polycarbonate, or any other suitable material. As best shown in FIG. 2, the lens 112 has a circular aperture 180 formed in or at an apex 182 of the lens 112. When the lens 112 is coupled to the housing 104, the circular aperture 180 is centered about a central longitudinal axis 184 of the lens 112, the axis 184 extending upward from the apex 182 and being co-axial with the central axis 146 of the housing 104.

In other versions, the lens 112 can have a different size, a different shape, and/or be coupled to the housing 104 in a different manner. For example, the lens 112 can have a rectangular, cylindrical, square, triangular, oval, irregular, or any other suitable shape, with the result that the lens 112 can distribute light in a different manner. A differently-shaped lens 112 may, for example, be used when the luminaire 100 is used in a different environment (e.g., when the luminaire 100 is mounted beneath an underpass, when the luminaire 100 is mounted in a stairwell). As another example, the lens 112 need not include the aperture 180, such as, for example, when the motion sensor 120 is wholly mounted within or outside of the lens 112.

Figure 5:
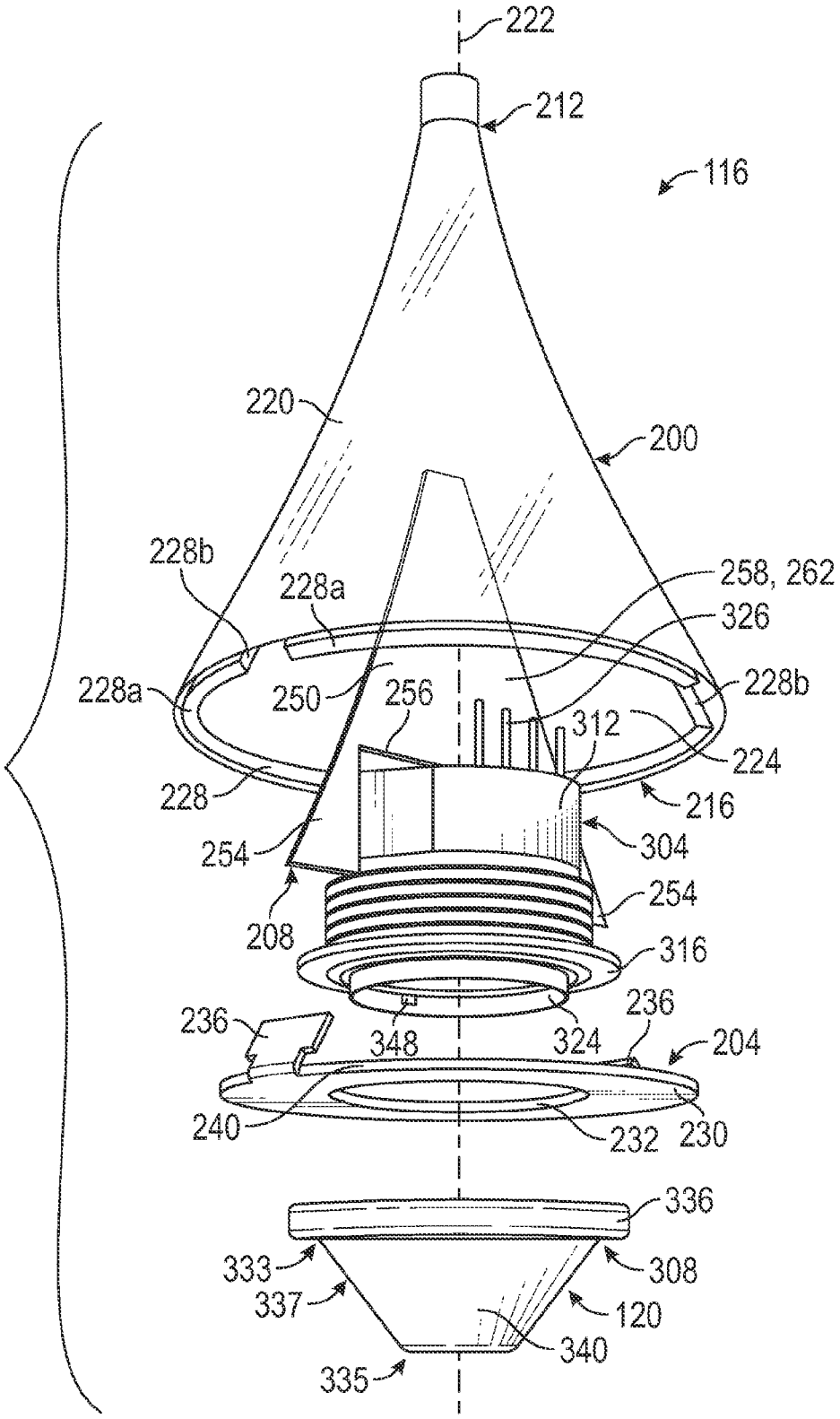
FIG. 5 is a perspective, exploded view of an exemplary support post assembly and motion sensor of the luminaire shown in FIG. 1.

FIG. 5 is an exploded view of the electronics control assembly 116 and the motion sensor 120. As shown in FIG. 5, the electronics control assembly 116 includes a support post 200, a bracket 204, and a printed control board 208. The support post 200 in this version has a concave conical shape with a first end 212, a second end 216, and a circumferential wall 220 extending between the first and second ends 212, 216. The wall 220 is centered about a central longitudinal axis 222 of the post 200 and has a diameter that increases from the first end 212 to the second end 216. The ends 212, 216 and the wall 220 define a hollow interior 224 of the post 200. The support post 200 further includes a ledge 228 arranged within the hollow interior 224 immediately adjacent or at the second end 216. The ledge 228 is formed by two opposing semi-circular portions 228A. Two openings 228B are defined by and between the semi-circular portions 228A.

The bracket 204 in this version is substantially flat and shaped like a donut, with an annular body 230 and a central opening 232 defined in the body 230. The bracket 204 includes a pair of tabs 236 that are coupled to and project upward and inward (toward the central opening 232) from opposite portions of an outer perimeter edge 240 of the bracket 204. Each tab 236 in this version is a T-shaped tab that is coupled to and projects upward and inward from the perimeter edge 240 at an approximately 60 degree angle relative to the bracket 204.

Finally, the printed circuit board 208 is sized to be disposed or seated within the hollow interior 224 of the support post 220. The printed circuit board 208 in this version has an A-shape, with a substantially triangular body 250 and a pair of substantially triangular arms 254 that project downward from a bottom end of the body 250. The body 250 and the arms 254 in turn define a substantially rectangular opening 256 therebetween.

Moreover, the electronics control assembly 116 can include one or more communication modules to communicatively couple components of the printed circuit board 208 to the local controller (e.g., a controller disposed within the housing 160), other luminaires 100 in the lighting system, the central controller, and/or other components of the control system interfaced with the lighting system. The communication modules can include one or more wireless communication modules and/or one or more wired communication modules. The one or more communication modules can thus facilitate wireless and/or wired communication between components of the printed circuit board 208 and the local controller, other luminaires 100, the central controller, and/or other control system components. More specifically, the one or more communication modules can facilitate the transfer of various data, such as occupancy or motion data, operational instructions (e.g., turn on, turn off, dim, etc.), etc., between the components of the printed circuit board 208 and the local controller, other luminaires 100, the central controller, and/or other control system components.

In the depicted version, the one or more communication modules include a first antenna 258 and a second antenna 262 each formed (e.g., printed, etched) into or onto the printed circuit board 208. For example as depicted, the first antenna 258 is an ANT-916-CW antenna configured to facilitate the above-described wireless communication at a frequency of approximately 916 MHz, while the second antenna 262 is an ANT-2.4-CW antenna configured to facilitate the above-described wireless communication at a frequency of approximately 2.4 GHz. It will thus be appreciated that the first and second antennae 258, 262 may facilitate wireless communication at different frequencies.

In other versions, the electronics control assembly 116 can include additional, different, or fewer components. Specifically, the support post 200, the bracket 204, and/or the printed control board 208 can vary in shape, size, and/or construction. While the support post 200 has a concave conical shape, the support post 200 can instead have a rectangular, cylindrical, triangular, irregular, or other shape. Similarly, the bracket 204 can instead have a rectangular, triangular, irregular, or other shape, and/or can have a different (e.g., thicker) profile. The openings 228B and the tabs 236 can also vary in construction. For example, the tabs 236 can have a different shape and/or can be angled at a different angle (e.g., 45 degrees) relative to the bracket 204. In some versions, the support post 200 and the bracket 204 can be coupled to one another in a different manner (e.g., not using the openings 228B and the tabs 236). In some versions, particularly when the support post 200 has a different shape, the printed circuit board 208 can have a different shape and/or size.

Moreover, while the electronics control assembly 116 includes wireless communication modules in the form of the first and second antennae 258, 262 etched into the printed circuit board 208, in other versions the communication modules can (i) include only one of the antennae 258, 262, more than two antennae, one or more different antennae, one or more other wireless modules, and/or one or more wired communication modules, and/or (ii) be arranged differently in the electronics control assembly 116 (e.g., arranged differently within the support post 200 or coupled to an exterior portion of the support post 200). It should further be appreciated that other known wireless communication protocols (e.g., wireless Ethernet, IEEE-802.11, Wi-Fi, Bluetooth, radio-frequency identification (RFID), Bluetooth low energy (BLE), ZigBee, near field communication) may be utilized.

Figure 6:
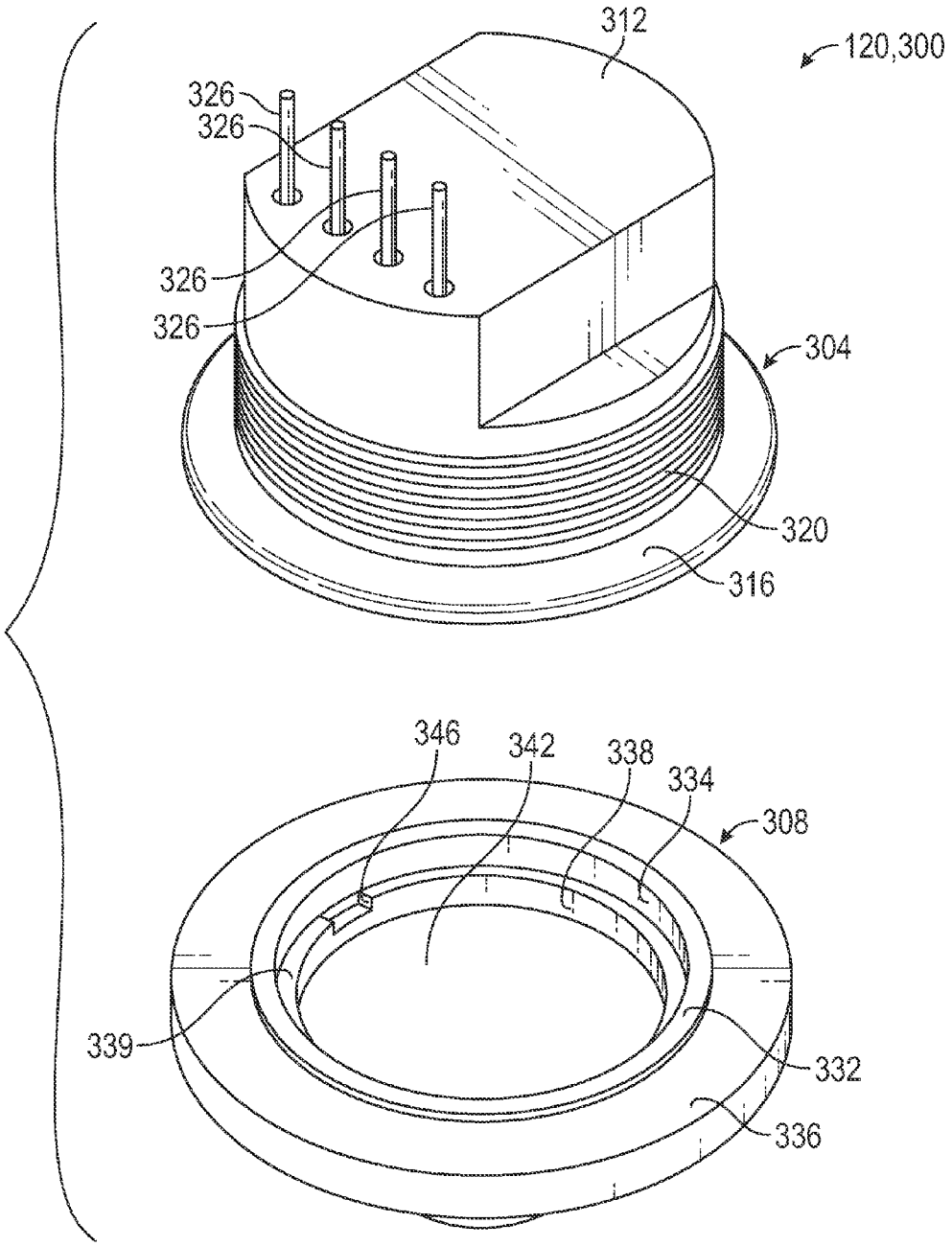
FIG. 6 is a perspective, exploded view of components of the motion sensor shown in FIG. 5.

With reference to FIGS. 5 and 6, the motion sensor 112 in this version is a passive infrared motion sensor 300 configured to detect motion within a pre-determined range or distance from the luminaire 100 by measuring or detecting infrared light radiating from objects in the pre-determined range of the luminaire 100. As shown in FIGS. 5 and 6, the motion sensor 300 includes a body portion 304 and a lens portion 308 that can be coupled to the body portion 304. The body portion 304 has a generally irregular shape, with a projection 312 that extends upward from the body portion 304, a skirt 316 that extends outward from and circumscribes the body portion 304, a threaded portion 320 extending between the projection 312 and the skirt 316, and a circumferential wall 324 that extends downward from the skirt 316 of the body portion 304. The body portion 304 further includes a plurality of prongs 326 that extend upward from the projection 312 to facilitate electronic communication between the motion sensor 300 and the printed circuit board 208, as will be described.

As illustrated in FIGS. 5 and 6, the lens portion 308 has an inner rim 332, a perimeter wall 336 that surrounds the inner rim 332, and a lens 340 (e.g., a Fresnel lens) that projects or extends downward from the perimeter wall 336. In this version, the inner rim 332 and the perimeter wall 336 have a cylindrical shape, while the lens 340 has a substantially conical shape defined by a first end 333, a second end 335, and a circumferential wall 337 that extends between the first and second ends 333, 335. The inner rim 332 and the lens 340 together define an interior opening 342 of the lens portion 308.

The inner rim 332 has an outer perimeter wall 334, an inner perimeter wall 338, and a channel 339 defined by and between the outer and inner perimeter walls 334, 338. The channel 339 is generally sized to receive the wall 324 of the body portion 304 when the lens portion 308 is coupled to the body portion 304. Two rectangular notches 346 are formed in opposite portions of the inner perimeter wall 338 (only one notch 346 is visible in FIG. 6). The notches 346 are sized and positioned to interact with the corresponding notches 348 formed in opposite sides of the wall 324 (the notches 348 are difficult to see in FIG. 5 and not visible in FIG. 6) when the lens portion 308 is coupled to the body portion 304. Finally, it should be appreciated that the diameter of the conical lens 340 at the first end 333 is substantially equal to the diameter of the circular aperture 180 of the lens 112.

While the motion sensor 112 in this version takes the form of the passive infrared motion sensor 300, the motion sensor 112 can alternatively take the form of a microwave motion sensor, an ultrasonic motion sensor, a tomographic motion sensor, or another type of motion sensor. In other versions, the passive infrared motion sensor 300 can vary in shape, size, and/or construction. Additional, fewer, or different components are envisioned. For example, the body portion 304 and the lens portion 308 can be integrally formed. In some versions, the body portion 304 and/or the lens portion 308 can vary in shape and/or size. When, for example, the aperture 180 of the lens 112 varies in shape and/or size, the lens 340 of the lens portion 308 can likewise have a different shape (e.g., a rectangular prism) and/or size. As another example, the wall 324 of the body portion 304 and the channel 339 of the lens portion 308 can vary in shape and/or size and still engage one another.

Figure 7:
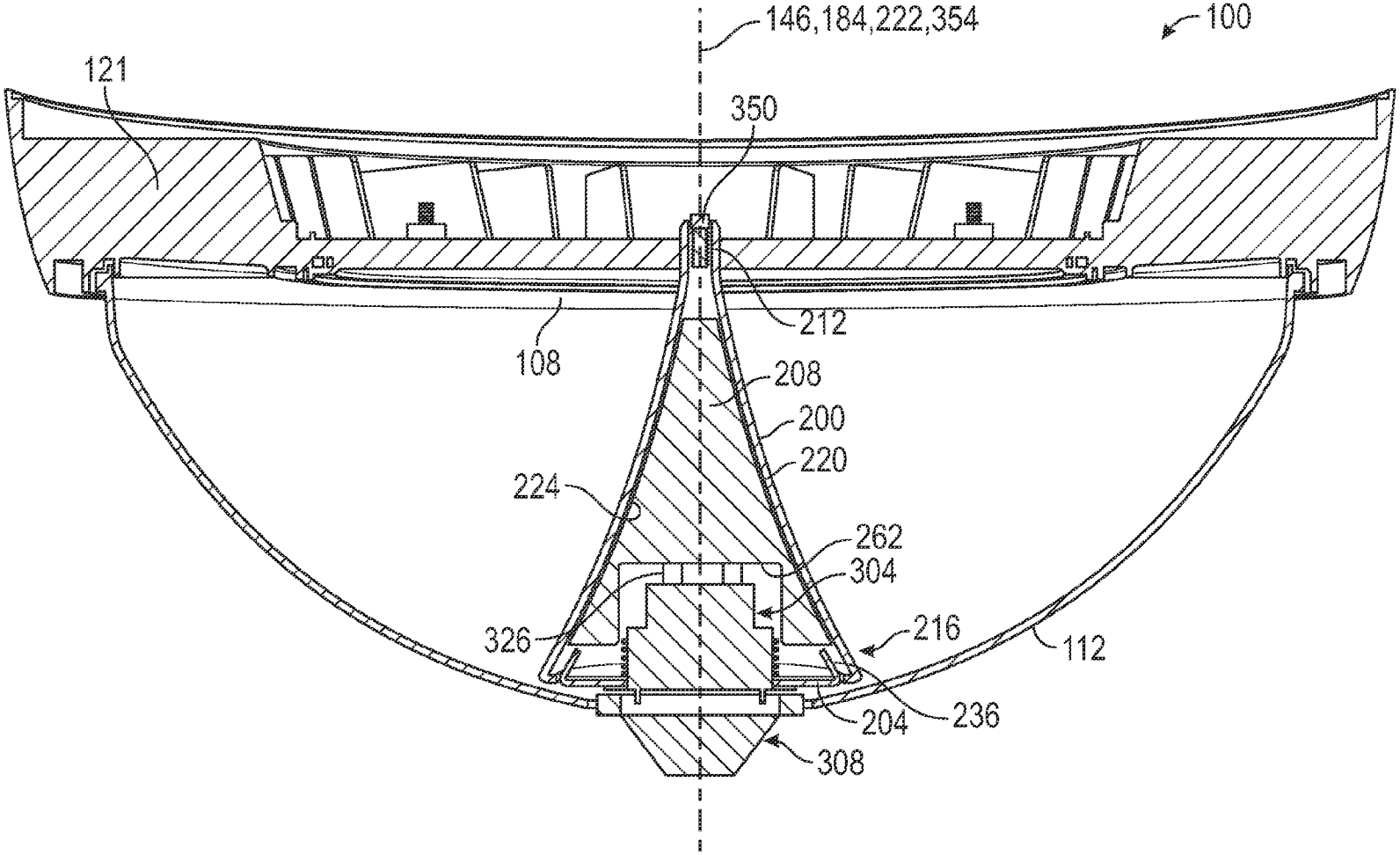
FIG. 7 is a cross-sectional view, taken along line 7-7 in FIG. 1, of the luminaire shown in FIG. 1.

FIG. 7 is a cross-sectional view of a portion of the luminaire 100 as assembled and including the body 121 of the housing 104, the light source 108, the lens 112, the electronics control assembly 116, and the motion sensor 120. The printed circuit board 140, the wiring 166, and the light source 108 can be disposed or seated in the cavity 138 in the manner described above. The support post 200 can be coupled to the body 121 of the housing 104 via a fastener 350 extending through and out of the first end 212 of the support post 200 and then inserted into the aperture 144B formed in the interior mounting surface 132 of the housing body 121. In turn, the central axis 222 of the post 200 is co-axial with the central axis 146 of the housing 104 and the support post 200 extends downward from the housing 104. The bracket 204 can be coupled to the body portion 304 of the motion sensor 300. More specifically, the bracket 204 can be seated on the skirt 316 of the body portion 304 (i.e., between the skirt 316 and the threaded portion 320 of the body portion 304). The printed circuit board 208 (including the antennas 258, 262) and the body portion 304 of the motion sensor 300 can be disposed, via the second end 216 of the support post 200, within the interior 224 of the post 200 such that the projection 312 of the motion sensor 300 is disposed within the opening 262 of the printed circuit board 208 and the prongs 326 are in electrical contact with the printed circuit board 208. At this point, the bracket 204, which is coupled to the body portion 304, can be coupled to the support post 200 to securely retain the printed circuit board 208 and the body portion 304 within the post 200. This can be done by seating the wall 324 of the body portion 304 in the opening 232 of the bracket 204 (thereby seating the skirt 316 on the bracket 204) and then inserting the tabs 236 of the bracket 204 into the openings 228B of the ledge 228 of the post 200. The tabs 236 will, in turn, interferingly contact the ledge portions 228A, thereby securing the bracket 204 to the support post 200.

As illustrated in FIG. 7, the lens 112 can be mounted or secured to the bottom side 128 of the housing body 121 such that the aperture 180 of the lens 112 (and, in turn, the apex 182) is centered about the central axis 146 of the housing 104 (i.e., the axis 184 of the lens 112 is co-axial with the central axis 146). The lens 112 can be mounted or secured in any known manner (e.g., via fasteners). The lens portion 308 of the motion sensor 300 can, in turn, be coupled to the body portion 304 of the motion sensor 300 and the electronics control assembly 116. This can be accomplished by disposing the circumferential wall 324 of the body portion 304 within the opening 342 of the lens portion 308 and seating the wall 324 in the channel 339 of the lens portion 304 such that the notches 346 interferingly contact the notches 348. By virtue of being coupled to the body portion 304, which is electrically coupled to the printed circuit board 208 via the prongs 326, the lens portion 308 is electrically coupled to the printed circuit board 208.

It will be appreciated that the components of the luminaire 100 can be assembled in a different manner and still produce the intended configuration. In other versions, some of the components of the luminaire 100 can be assembled in a different order than described herein. For example, the lens 112 can be mounted or secured to the bottom side 128 of the housing body 121 after the lens portion 308 of the motion sensor 300 has been coupled to the body portion 304 of the motion sensor 300. In other versions, the components of the luminaire 100 can be coupled to one another in a different manner. For example, instead of being supported by the housing 104, the support post 200 can be supported by the lens 112 (e.g., by resting directly on the lens 112). As another example, the body portion 304 and the lens portion 308 of the motion sensor 300 can be integrally formed with one another or coupled to one another in a different manner.

In any event, when assembled, the components of the electronics control assembly 116 and the body portion 304 of the motion sensor 300 are disposed between the housing 104 and the lens 112, as illustrated in FIGS. 1 and 7. In other words, the downwardly facing lens 112 substantially encloses the components of the electronics control assembly 116 and the body portion 304 of the motion sensor 300. The perimeter wall 336 of the lens portion 308 is disposed substantially within the opening 180 of the lens 112, leaving the lens 340 of the motion sensor 300 exposed (i.e., not enclosed by the lens 112) and extending downward from the apex 182 of the lens 112. As also illustrated in FIGS. 1 and 7, the housing 104, the lens 112, the electronics control assembly 116, and the motion sensor 300 are centered about the same longitudinal axis (i.e., the axis 146, the axis 184, the axis 222, and a longitudinal axis 354 extending through a center of the motion sensor 300 are co-axial).

In operation, the lens 340 of the motion sensor 300 is, by virtue of being centered on and extending downward from the luminaire 100, positioned to accurately detect motion, whether from a person, an animal, a vehicle, or another object, within a pre-determined range of or distance from the luminaire 100. The way in which the motion sensor 300 detects motion is known in the art, so will not be described herein. The pre-determined range or distance can be 50 feet, 100 feet, or some other distance set by the local controller (in the housing 104), the central controller, and/or a user of the luminaire 100 or the control system.

In any event, when the motion sensor 300 detects motion (i.e., occupancy) within the pre-determined range, this information is communicated to the components of the printed circuit board 208, which can in turn transmit this information to the local controller (in the housing 104). The local controller can, responsive to this information, subsequently cause the light source 108 to emit light or to emit more light. Alternatively or additionally, the components of the printed circuit board 208 (e.g., the antennae 258, 262) can transmit this information to the central controller and/or other luminaires 100. Based on this information, other luminaires 100, particularly adjacent luminaires 100, can be controlled accordingly (e.g., turned on, turned off, or dimmed).

Conversely, when the motion sensor 300 does not detect motion (i.e., no occupancy) within the pre-determined range, this information is similarly communicated to the printed circuit board 208, which can in turn transmit this information to the local controller. If the light source 108 is emitting light at the time of this detection (of no motion), the local controller can, responsive to this information, subsequently cause the light source 108 to emit less light (i.e., dim) or no light at all. Alternatively or additionally, the components of the printed circuit board 208 (e.g., the antennae 258, 262) can transmit this information to the central controller and/or other luminaires 100. Based on this information, other luminaires 100, particularly adjacent luminaires 100, can be controlled accordingly (e.g., turned off, turned on, or dimmed).

In view of the foregoing, it should be appreciated that the luminaire described herein advantageously includes various optically positioned sensing and communication components that, for example, allow the luminaire to energize upon detecting the presence of people, animals, or vehicles within a pre-determined range of or distance from the luminaire and communicate data, such as operating data, instructions, and occupancy data, with a control system and/or other luminaires.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Some embodiments may be described using the expression "coupled" and "connected" along with their derivatives. For example, some embodiments may be described using the term "coupled" to indicate that two or more elements are in direct physical or electrical contact. The term "coupled," however, may also mean that two or more elements are not in direct contact with each other, but yet still cooperate or interact with each other. The embodiments are not limited in this context.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the description. This description, and the claims that follow, should be read to include one or at least one and the singular also includes the plural unless it is obvious that it is meant otherwise.

This detailed description is to be construed as examples and does not describe every possible embodiment, as describing every possible embodiment would be impractical, if not impossible. One could implement numerous alternate embodiments, using either current technology or technology developed after the filing date of this application.

The invention claimed is:

1. A luminaire, comprising:

a housing;

a light source disposed in the housing;

a lens coupled to the housing and covering the light source; and one or more communication modules configured to operate at various frequencies and disposed within a support element coupled to the housing, the support element disposed along a center axis of the luminaire and extending upward from an apex of the lens.

2. The luminaire of claim 1, wherein the support element is coupled to and extends downward from the housing.

3. The luminaire of claim 1, wherein the support element comprises a support post having a hollow, generally conical shape.

4. The luminaire of claim 1, further comprising a motion sensor coupled to the support element, the motion sensor configured to detect motion within a pre-determined range of the luminaire, the light source configured to emit light responsive to the motion sensor detecting motion within the predetermined range.

5. The luminaire of claim 4, further comprising a printed circuit board disposed in the support element along the central axis, the motion sensor being communicatively coupled to the printed circuit board.

6. The luminaire of claim 4, wherein the motion sensor comprises a motion detecting lens, the motion detecting lens being exposed adjacent the apex of the lens.

7. The luminaire of claim 5, wherein the motion sensor comprises a passive infrared sensor, the motion detecting lens having a conical shape.

8. The luminaire of claim 6, wherein the motion sensor is wholly mounted within the lens.

9. The luminaire of claim 8, wherein the lens does not include an aperture adjacent to the motion detecting lens.

10. The luminaire of claim 6, further comprising an aperture in the apex of the lens, the motion detecting lens being disposed substantially within the aperture.

11. The luminaire of claim 1, wherein the one or more communication modules comprise a first antenna and a second antenna each disposed within the support element, the first antenna configured to facilitate communication at a first frequency and the second antenna configured to facilitate communication at a second frequency different from the first frequency.

12. A luminaire, comprising:

a housing;

a light source disposed in the housing;

a support element coupled to and extending downward from the housing;

a lens coupled to the housing and covering the light source and the support element;

one or more communication modules disposed within the support element; and a motion sensor coupled to the support element adjacent an apex of the lens, the motion sensor configured to detect motion within a pre-determined range of the luminaire, the light source configured to emit light responsive to the motion sensor detecting motion within the pre-determined range.

13. The luminaire of claim 12, wherein the support element is disposed along a center axis of the luminaire extending upward from an apex of the lens.

14. The luminaire of claim 12, wherein the support element comprises a support post having a hollow, generally conical shape.

15. The luminaire of claim 12, wherein the motion sensor comprises a motion detecting lens, the motion detecting lens being disposed at the apex of the lens along a central axis of the luminaire.

16. The luminaire of claim 15, further comprising an aperture in the apex of the lens, the motion detecting lens being disposed substantially within the aperture.

17. The luminaire of claim 12, wherein the motion sensor comprises a passive infrared sensor, the motion detecting lens having a conical shape.

18. The luminaire of claim 12, further comprising a printed circuit board disposed in the support element, the motion sensor being communicatively coupled to the printed circuit board.

19. The luminaire of claim 12, wherein the one or more communication modules comprise a first antenna and a second antenna each disposed within the support element, the first antenna configured to facilitate communication at a first frequency and the second antenna configured to facilitate communication at a second frequency different from the first frequency.

20. The luminaire of claim 12, wherein the motion sensor is wholly mounted within the lens.

21. The luminaire of claim 20, wherein the lens does not include an aperture adjacent to the motion sensor.

22. A luminaire, comprising:

a housing;

a light source disposed in the housing;

a lens coupled to the housing and covering the light source;

a motion sensor disposed adjacent to an apex of the lens; and one or more wireless modules disposed adjacent the motion sensor, the motion sensor configured to detect motion within a pre-determined distance from the luminaire, the light source configured to emit light responsive to the motion sensor detecting motion within the pre-determined distance.

23. The luminaire of claim 22, wherein the motion sensor is disposed along a central axis of the luminaire.

24. The luminaire of claim 22, further comprising a conical support post coupled to and extending downward from the housing, the conical support post being disposed along a central axis of the luminaire, the motion sensor being coupled to the support post.

25. The luminaire of claim 22, wherein the motion sensor is wholly mounted within the lens.

26. The luminaire of claim 25, wherein the lens does not include an aperture adjacent to the motion detecting lens.

27. The luminaire of claim 22, further comprising an aperture in the apex of the lens, the motion detecting lens being disposed substantially within the aperture.

* * * * *